US005167525A

United States Patent [19]

Wang

[11] Patent Number: 5,167,525

[45] Date of Patent: Dec. 1, 1992

[54] COAXIAL ACTIVE TAP DEVICE FOR A COMPUTER NETWORK SYSTEM

[76] Inventor: Tsan-Chi Wang, No. 13, Lane 312, Chungcheng Rd., Hsin Tien, Taipei Hsien, Taiwan

[21] Appl. No.: 865,931

[22] Filed: Apr. 9, 1992

[51] Int. Cl.[5] ..... H01R 4/24

[52] U.S. Cl. ..... 439/394; 439/581

[58] Field of Search ..... 439/578-585, 439/63, 225, 389-394, 425, 417-419, 409, 411-413

[56] References Cited

U.S. PATENT DOCUMENTS

| | | | |
|---|---|---|---|
| 4,437,722 | 3/1984 | Bianchi | 439/394 |
| 4,588,249 | 5/1986 | Blichasz et al. | 439/394 |
| 4,687,446 | 8/1987 | Birch et al. | 439/581 |
| 4,850,895 | 7/1989 | Arai et al. | 439/394 |
| 5,011,428 | 4/1991 | Heng et al. | 439/394 |
| 5,076,799 | 12/1991 | Virgo | 439/394 |

*Primary Examiner*—David L. Pirlot

*Attorney, Agent, or Firm*—Varndell Legal Group

[57] ABSTRACT

A coaxial active tap device comprising an upper fitting plate connected to a bottom fitting plate in holding a coaxial cable to be connected, an insulative casing attached to said bottom fitting plate in holding a signal terminal, two earth terminals inserted in two recessed holes on the bottom edge of said upper fitting plate and automatically pierced through the insulator in connecting the braided outer conductor said said coaxial cable, and earth element attached to said insulative casing on the inside and incorporated with said earth terminals into an earth circuit in connecting said braided outer conductor of said coaxial cable to the earth circuit of the series-parallel transition device to be connected.

3 Claims, 6 Drawing Sheets

COAXIAL ACTIVE TAP DEVICE FOR A COMPUTER NETWORK SYSTEM

BACKGROUND OF THE INVENTION

The present invention relates to a coaxial active tap device for a computer network system.

FIG. 6 illustrates a coaxial active tap device which is produced by AMP Incorporated, Harrisburg, Pa., USA, under the product name of AMP Coaxial Active TAP Kit 228751. In this structure of coaxial active tap device, two fitting plates are connected together to hold the coaxial cable to be connected. The upper fitting plate has a pressure board controlled by a screw bolt to squeeze the coaxial cable against two earth terminals, so that the earth terminals pierce through the outer insulator and connect the braided outer conductor of the coaxial cable to earth. One disadvantage of this structure of coaxial active tap device is that the outer thread of the screw bolt or the inner thread of the bolt hole, into which the screw bolt fits, may be damaged easily. Another disadvantage of this structure of coaxial active tap device is that the pressure from the screw bolt may be unevenly distributed through the pressure, causing earth contact failure. Still another disadvantage of this structure of coaxial active tap device is its complicated structure and expensive manufacturing cost. Furthermore, because the earth terminals are respectively inserted in corresponding contact holes on the series-parallel transition device and simultaneously bear the pressure from the coaxial cable, they may be caused to displace easily.

SUMMARY OF THE INVENTION

The present invention has been accomplished to eliminate the aforesaid disadvantages. According to one aspect of present invention, the upper and bottom fitting plates are connected by two opposite pairs of screws, and therefore the earth terminals are evenly squeezed into positive positions in connecting the braided outer conductor of the coaxial cable to be connected to earth. According to another aspect of the present invention, an earth element is firmly secured to an insulative casing by a screw means and incorporated with the earth terminals into an earth circuit for connecting to the earth circuit of the series-parallel transition device to be connected. Because the earth element does not bear the pressure from the coaxial cable to be connected, it will not be caused to displace.

DETAILED DESCRIPTION OF THE PREFERRED EMBODIMENT

Figure 1:
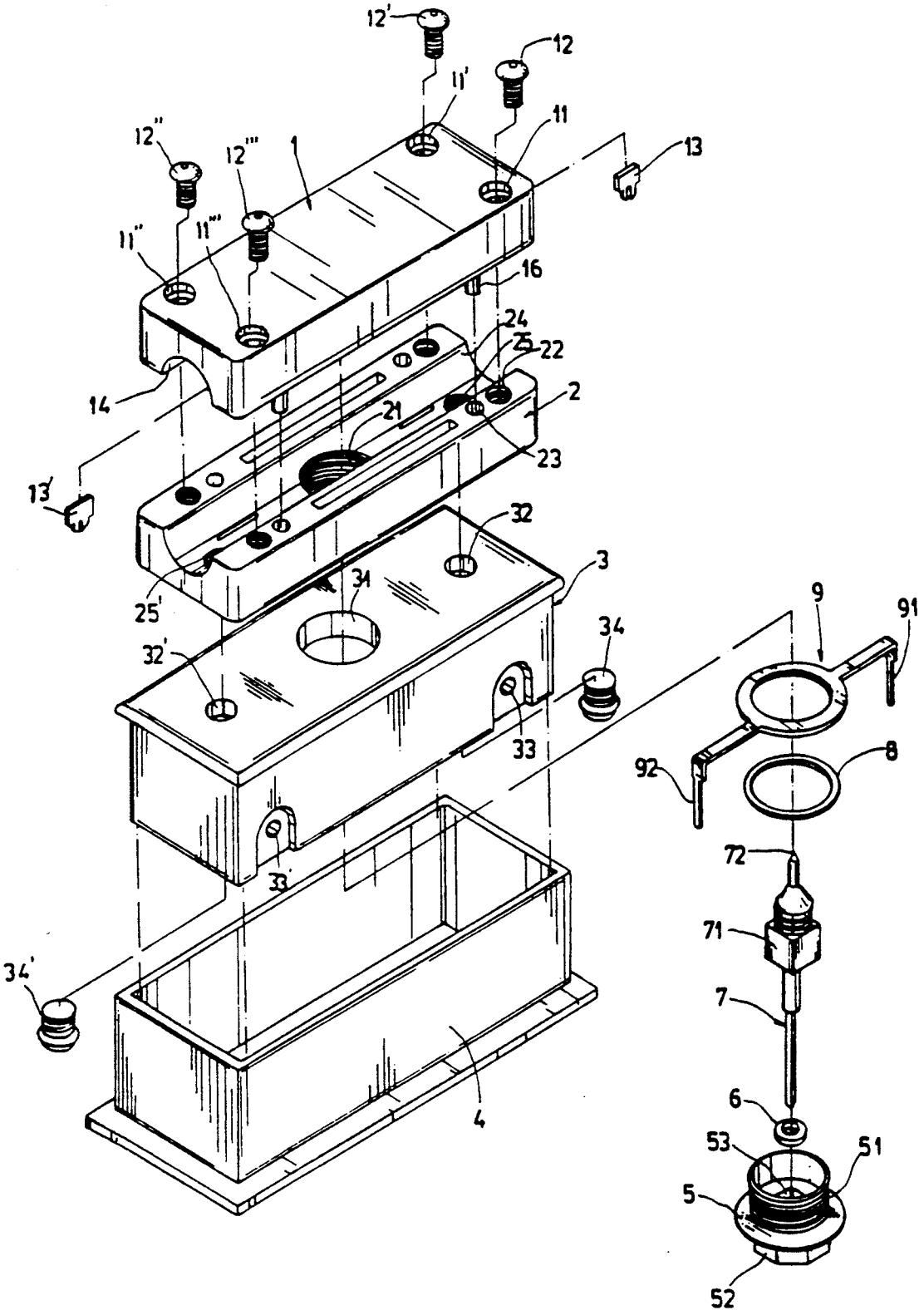
FIG. 1 is an exploded view of the preferred embodiment of the present invention.
Figure 2:
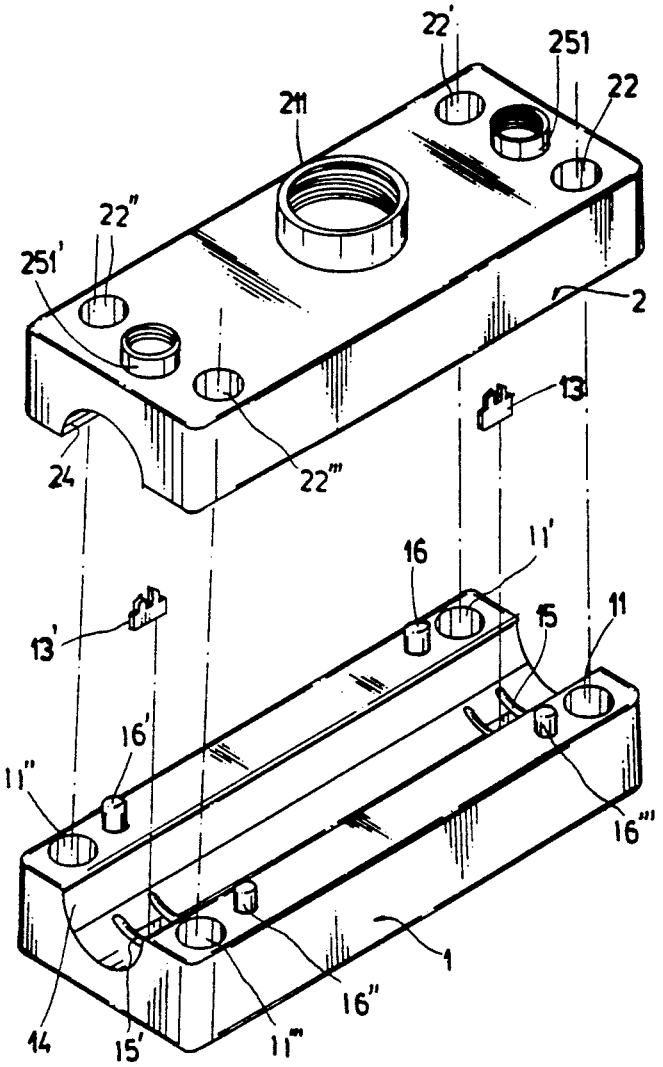
FIG. 2 is an exploded view of the upper and bottom fitting plates.
Figure 3:
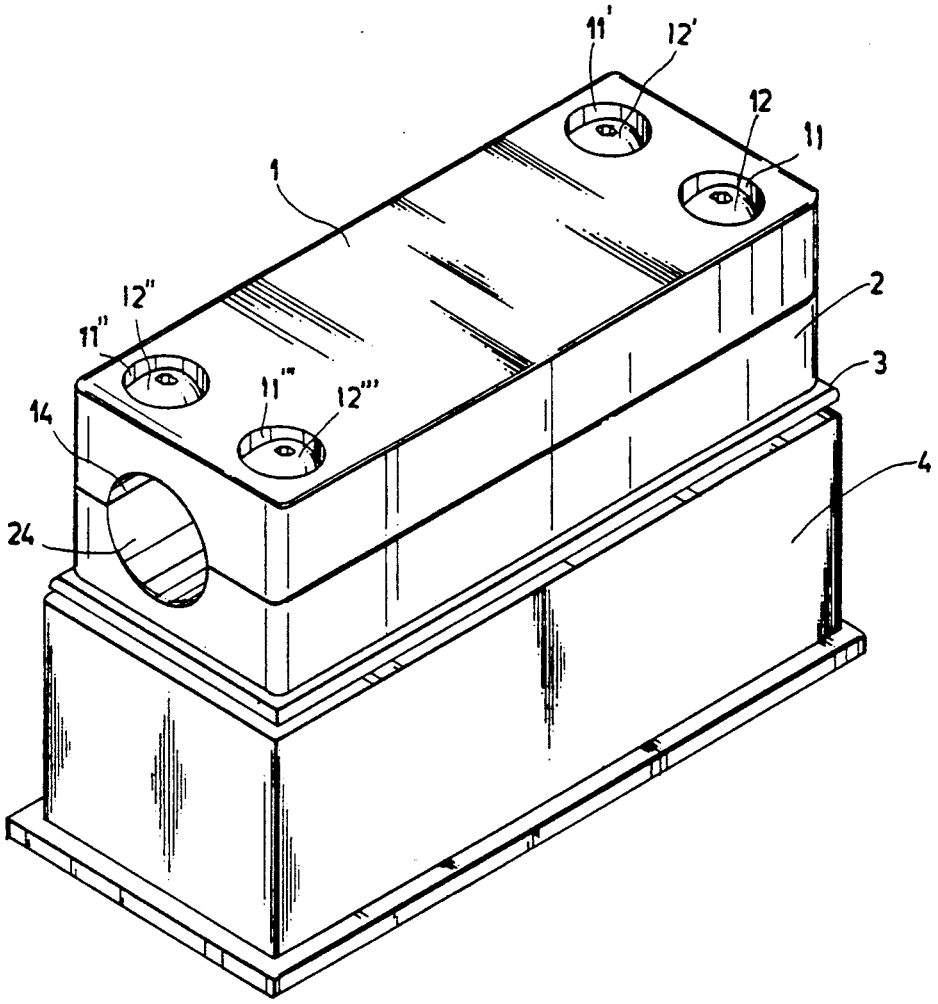
FIG. 3 is an elevational view of the preferred embodiment of the present invention.

Referring to FIGS. 1, 2 and 3, a coaxial active tap device is generally comprised of an upper fitting plate 1, a bottom fitting plate 2, an insulative casing 3, and a protective outer shell 4. The upper fitting plate 1 is made in a rectangular shape having a longitudinal groove 14 on the bottom edge through the longitudinal center line thereof, two opposite pairs of pins 16,16',16'',16''' bilaterally upstanding from the bottom edge thereof at two opposite ends, two I-shaped recessed holes 15,15' on the longitudinal groove 14 at two opposite ends into which earth terminals 13,13' are respectively inserted, two opposite pairs of countersunk holes 11,11',11'',11''' bilaterally formed at two opposite ends adjacent to the two opposite end edges thereof. The bottom fitting plate 2 fits the upper fitting plate 1 in size and shape, having bolt holes 22,22', 22'', 22''' and pin holes 23 corresponding to the countersunk holes 11,11',11'',11''' and the pins 16,16',16'', 16''' respectively, a longitudinal groove 24 on the top edge thereof which incorporated with the longitudinal groove 14 into a round hole for inserting a coaxial cable, a center bolt hole 21 through the longitudinal groove 14 at the center, and two end bolt holes 25,25' through the longitudinal groove 14 at two opposite ends. Flanges 211,251,251' are formed on the bottom edge of the bottom fitting plate 2 around the bolt holes 21,25,25', which are respectively inserted into corresponding holes 31,32,32' on the top edge of the insulative casing 3. The insulative casing 3 has two opposite pairs of through holes 33,33' on the two opposite, large side walls thereof for inserting screws in securing a series-parallel transition device on the inside. During the assembly process of the coaxial active tap device, countersunk screws 12,12',12''',12''' are respectively inserted through the countersunk holes 11,11',11'',11''' and screwed into the bolt holes 22,22',22'',22''' to fixedly secure the upper and bottom fitting plates 1,2 together, then, the flanges 211,251,251' of the bottom fitting plate 2 are respectively inserted into holes 34,32,32' and secured in place by screws 34,34' (which are respectively inserted through holes 32,32' and screwed into bolt holes 32,32'), and then, an earth element 9 and a signal terminal 7 are secured to the center bolt hole 21 of the bottom fitting plate 2 by a screw element 5, with a ring-shaped cushion 8 retained between the earth element 9 and the screw element 5 and, with a rubber ring 6 retained between the screw element 5 and the insulator 71 of the signal terminal 7. The screw element 5 has a hole 53 on the inside which receives the insulator 71, an outer thread 51 at one end screwed into the center bolt hole 21, and a hexagon 52 at an opposite end.

Figure 4:
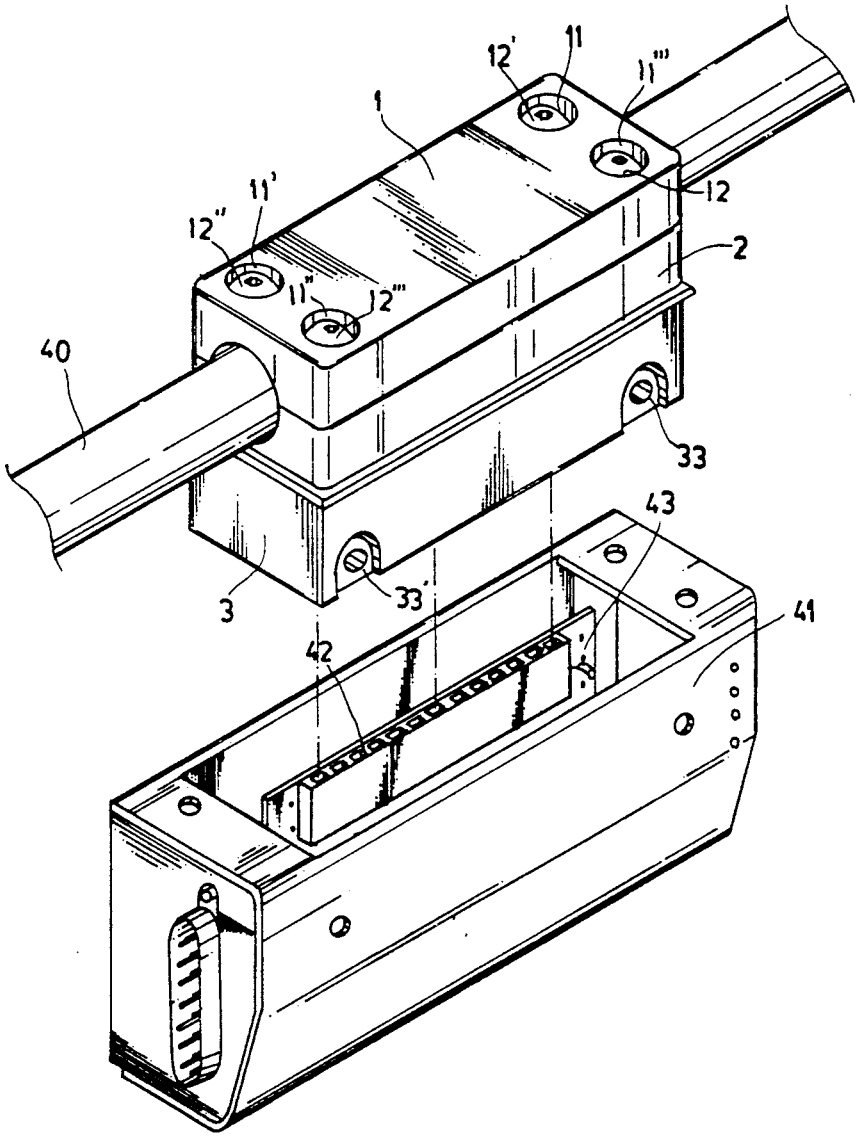
FIG. 4 is an assembly view showing the installation of the present invention in connecting a coaxial cable to a series-parallel transition device.
Figure 5:
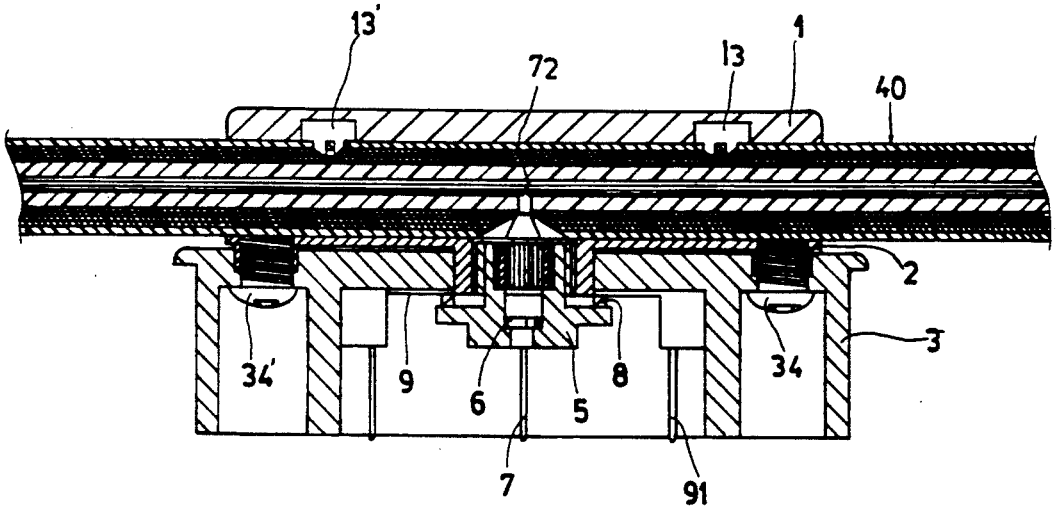
FIG. 5 is a cross section showing that the connection between the coaxial cable and the signal terminal, and the connection between the coaxial cable and the earth terminals.
Figure 6:
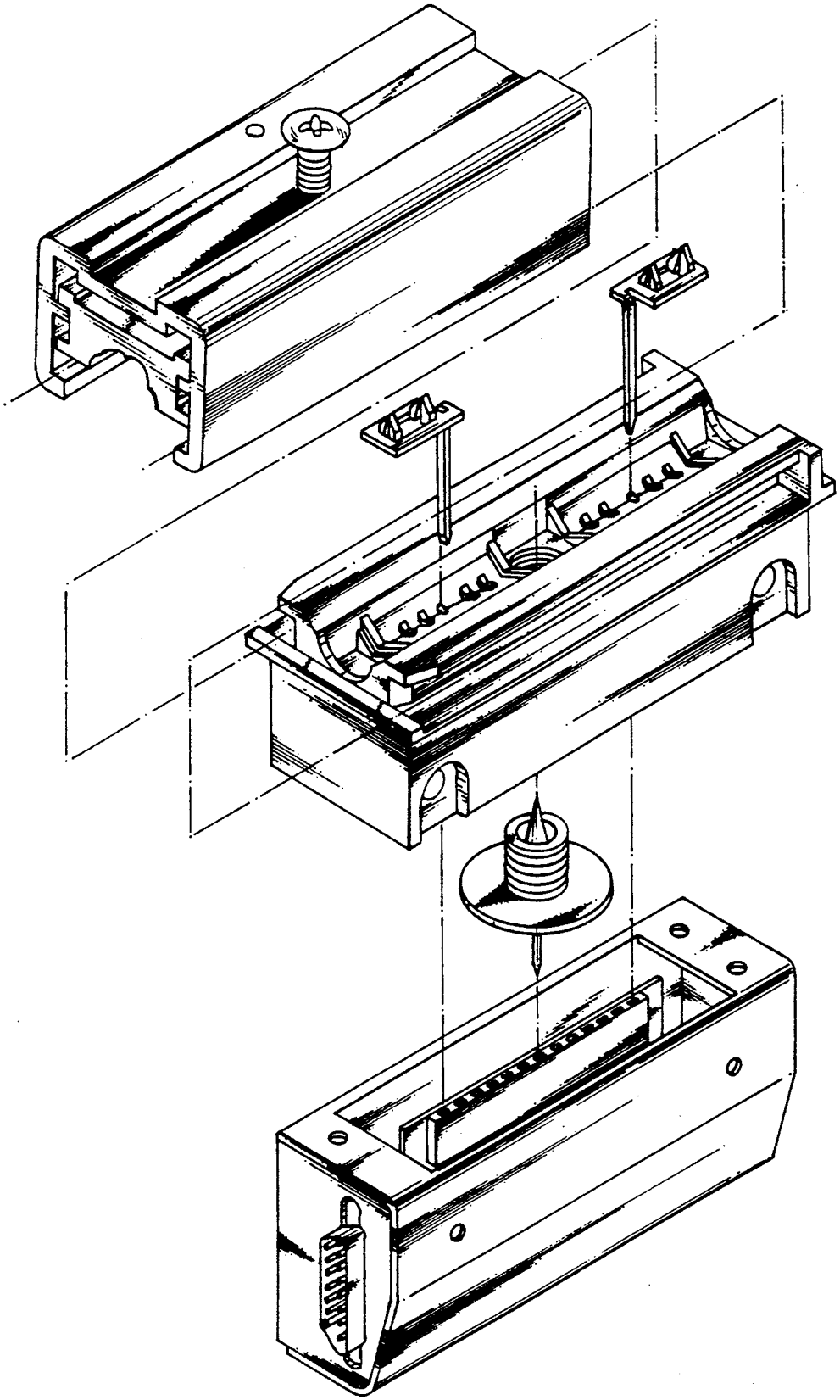
Fig. 6 PRIOR ART
FIG. 6 is an exploded view of a prior art coaxial active tap kit.

Referring to FIG. 4, the coaxial cable 40 to be connected is placed in the longitudinal grooves 14,24 before the upper and bottom fitting plates 1,2 being fixedly connected together. After the earth element 9, the signal terminal 7, the ring-shaped cushion 8 and the rubber ring 6 having been secured to the bottom fitting plate 2 by the screw element 5, the pointed contact end 72 of the signal terminal 7 pierces through the insulator and the intermediate tube of electrically conducting material (the braided outer conductor) of the coaxial cable 40 to electrically connect the central conductor thereof. Once a series-parallel transition device 41 has been fastened to the insulator casing 3 on the inside, the bottom end of the signal terminal 7 and the two opposite terminals 91 of the earth element 9 are respectively inserted into corresponding contact holes 42 on the PC board 43 of the series-parallel transition device Referring to FIG. 5, the earth terminals 13,13' respectively pierce through the outer insulator to connect the braided outer conductor to the earth element 9 via the ring-shaped cushion 8 and the bottom fitting plate 2, forming into an earth circuit. At the same time, the pointed end 72 of the signal terminal 7 connects the central conductor of the coaxial cable to the series-parallel transition device for signal transmission. The arrangement of the rubber ring 6 is to absorb or reduce vibrating waves transmitted through the signal terminal 7, and therefore the pointed end 72 of the signal terminal 7 will not be damaged easily.

I claim:

1. An coaxial active tap device for a computer network system, the improvement comprising:

an upper fitting plate, said upper fitting plate comprising a longitudinal groove and two opposite pairs of pins on a bottom edge thereof, two I-shaped recessed holes on the longitudinal groove at two opposite ends into which two earth terminals are respectively inserted, and two opposite pairs of countersunk holes at two opposite ends;

a bottom fitting plate attached to said upper fitting plate to hold a coaxial cable therebetween, said bottom fitting plate comprising two opposite pairs of bolt holes respectively connected to said countersunk holes by countersunk screws, two opposite pairs of pin holes into which said pins fit, a longitudinal groove on a top edge thereof incorporated with the longitudinal groove on said upper fitting plate to receive a coaxial cable to be connected, a center bolt hole on the longitudinal groove thereof at the center, two fastening bolt holes on the longitudinal groove thereof at two opposite ends, a circular flange on a bottom edge thereof surrounding around said center bolt hole, and an earth element mounted on said circular flange; and an insulative casing attached to said bottom fitting plate at the bottom to hold a signal terminal, said insulative casing comprising a center hole into which said circular flange fits, two through holes at two opposite ends respectively connected to said two fastening bolt holes by screws.

2. A coaxial active tap device according to claim 1, wherein the two earth terminals in said I-shaped recessed holes are respectively connected to said earth element forming into an earth circuit.

3. A coaxial active tap device according to claim 2, wherein said earth element has two vertical terminals at two opposite ends respectively connected to the earth circuit of a series-parallel transition device to be connected.

* * * * *